US010054305B1

(12) United States Patent
Slepack

(10) Patent No.: US 10,054,305 B1
(45) Date of Patent: Aug. 21, 2018

(54) 3-IN-1 SELF-DEFENSE APPARATUS

(71) Applicant: Vincent Slepack, Murrieta, CA (US)

(72) Inventor: Vincent Slepack, Murrieta, CA (US)

( * ) Notice: Subject to any disclaimer, the term of this patent is extended or adjusted under 35 U.S.C. 154(b) by 0 days.

(21) Appl. No.: 15/608,998

(22) Filed: May 30, 2017

(51) Int. Cl.

| | |
|---|---|
| ***F21V 33/00*** | (2006.01) |
| ***F21L 4/08*** | (2006.01) |
| ***F21V 23/04*** | (2006.01) |
| ***G08B 15/00*** | (2006.01) |
| ***F41H 9/10*** | (2006.01) |
| ***F41H 13/00*** | (2006.01) |
| *F21Y 115/10* | (2016.01) |

(52) U.S. Cl.
CPC ..... *F21V 33/0064* (2013.01); *F21L 4/08* (2013.01); *F21V 23/04* (2013.01); *F41H 9/10* (2013.01); *F41H 13/0018* (2013.01); *G08B 15/004* (2013.01); *F21Y 2115/10* (2016.08)

(58) Field of Classification Search
CPC ..... F21V 33/0064; F21V 23/04; F41H 9/10; F41H 13/0018; F21L 4/08; G08B 15/004; F21Y 2115/10
See application file for complete search history.

(56) References Cited

U.S. PATENT DOCUMENTS

| | | | | |
|---|---|---|---|---|
| 7,004,597 | B2 | 2/2006 | Kukuk | |
| 7,524,076 | B2 * | 4/2009 | Kukuk | F41C 23/10 362/109 |
| 7,787,232 | B2 | 8/2010 | Abatemarco | |
| 2010/0304874 | A1 * | 12/2010 | Abatemarco | A45B 3/04 463/47.3 |
| 2016/0012701 | A1 * | 1/2016 | Lu | F41H 9/10 222/183 |
| 2018/0051964 | A1 * | 2/2018 | Forsythe | B05B 9/01 |

* cited by examiner

*Primary Examiner* — Kevin Quarterman

(57) ABSTRACT

A 3-in-1 self-defense apparatus with a blinding LED light panel, pepper spray, and a stun gun in a compact and unassuming form factor. A pepper spray canister is disposed within the top of the tubular handle. The blinding LED light panel is disposed within the front of said handle, and the stun gun is disposed within the bottom of said handle. A rechargeable battery housed inside the handle provides power to the LED light panel and to the stun gun. The battery is charged with a USB port disposed within the back of the handle next to a plurality of controls which are used for the light and the stun gun. A plurality of concave indentations along the handle, as well as an adjustable wrist strap disposed to the top of the handle, provide grip for the user.

1 Claim, 4 Drawing Sheets

3-IN-1 SELF-DEFENSE APPARATUS

BACKGROUND OF THE INVENTION

Various types of self-defense weapons are known in the prior art. However, most existing self-defense weapons are limited to only one option, such as pepper spray or an electric shock. In the event of an attack, the circumstances may call for a variety of weapons. The beginning of the encounter may only call for the identification and discombobulation of an unknown approaching stranger, in which case a blinding light is ideal. Once the stranger is identified as a threat, but is still a distance away, pepper spray becomes the ideal deterrent. Finally, once the attacker is upon the victim, a stun gun becomes the best option. What is needed, and what the present 3-in-1 self-defense apparatus provides, is a combination self-defense weapon having a blinding LED light panel, a pepper spray, and a stun gun. Other existing combination weapons are often too large, or are designed for police or military use and to be worn on a utility belt. The present 3-in-1 self-defense weapon is compact and unassuming, and is thus an ideal weapon to be kept in a small bag or purse by everyday citizens.

FIELD OF THE INVENTION

The present invention relates to self-defense weapons, and more particularly, to a 3-in-1 self-defense apparatus.

SUMMARY OF THE INVENTION

The general purpose of the present 3-in-1 self-defense apparatus, described subsequently in greater detail, is to provide a 3-in-1 self-defense apparatus that has many novel features that result in a 3-in-1 self-defense apparatus that is not anticipated, rendered obvious, suggested, or even implied by prior art, either alone or in combination thereof.

To accomplish this, the present 3-in-1 self-defense apparatus includes a tubular handle having an inside, a front side, a back side, a top side, a bottom side, and a plurality of concave indentations designed to provide a secure and comfortable grip for both left handed and right handed users. For midrange to close range encounters with an attacker, there is a pepper spray canister disposed within the top side of the tubular handle. The pepper spray canister has an activation lever along the back side of the handle and a forward facing nozzle aligned with the front side of said handle. The activation lever can be depressed either by the user's grip hand thumb, or by the user's offhand, thus dispensing the pepper spray.

A rechargeable battery is housed inside of the tubular handle, and a plurality of indicator lights disposed within the front side of the tubular handle proximal the bottom side thereof is configured to indicate a charge level of said rechargeable battery.

The first line of defense offered by the present 3-in-1 self-defense apparatus is an LED light panel disposed within the front side of the tubular handle. This LED light panel is bright enough not only to identify a potential attacker, but also to blind him and leave him discombobulated. The LED light panel is in operational communication with the rechargeable battery.

The closest range weapon available is a stun gun disposed within the bottom of the tubular handle. The stun gun has a plurality of metal contacts that protrude from the bottom of the tubular handle, and the stun gun is in operational communication with the rechargeable battery and is configured to deliver an electric shock to the attacker via the plurality of metal contacts.

In order to charge the rechargeable battery that powers the LED light panel and the stun gun, a USB connector is disposed within the back side of the tubular handle. This USB connector is in operational communication with the rechargeable battery.

The electrical features of the 3-in-1 self-defense weapon are operated by a plurality of controls disposed within the back side of the tubular handle. One of the plurality of controls is in operational communication with the LED light panel and is configured to activate and deactivate said LED light panel. Another one of the plurality of controls is in operational communication with the stun gun and is configured to activate and deactivate said stun gun.

There is an adjustable strap disposed to the top of the tubular handle for a user to place around his or her wrist.

Thus have been broadly outlined the more important features of the present 3-in-1 self-defense apparatus so that the detailed description thereof that follows may be better understood and in order that the present contribution to the art may be better appreciated.

BRIEF DESCRIPTION OF THE DRAWINGS

Figures

DETAILED DESCRIPTION OF THE DRAWINGS

Figure 1:
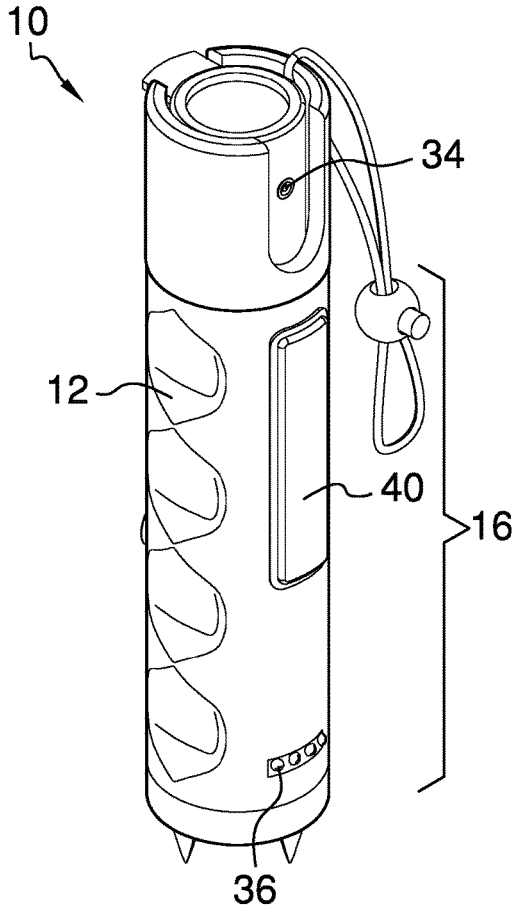
FIG. 1 is an isometric view of a 3-in-1 self-defense apparatus.
Figure 2:
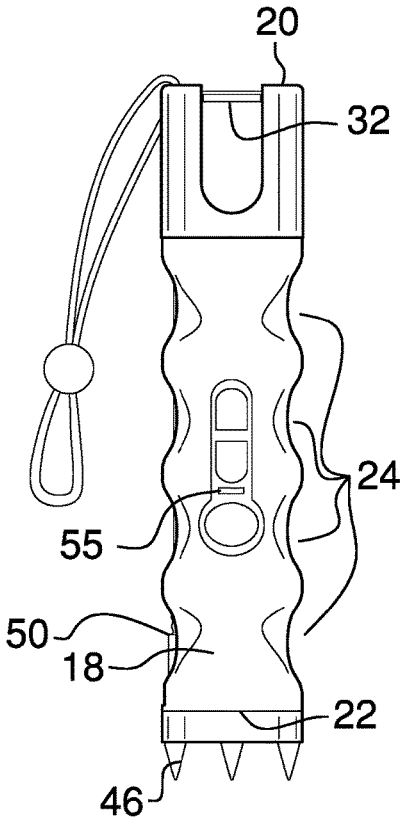
FIG. 2 is a side elevation view of the 3-in-1 self-defense apparatus.
Figure 3:
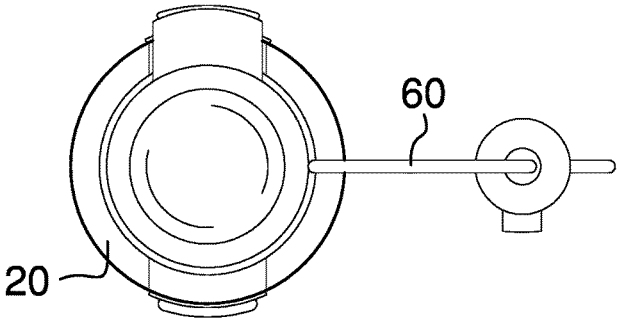
FIG. 3 is a top plan of the 3-in-1 self-defense apparatus.
Figure 4:
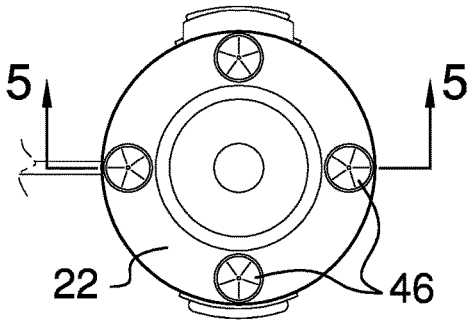
FIG. 4 is a bottom plan view of the 3-in-1 self-defense apparatus.
Figure 5:
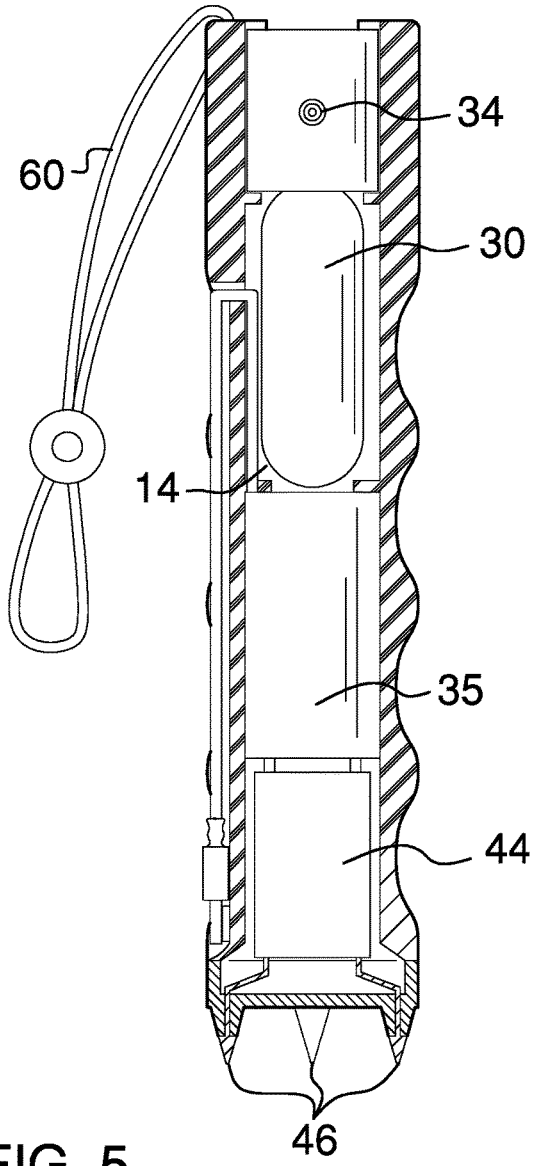
FIG. 5 is a cross-sectional view along line 5-5 of FIG. 4.
Figure 6:
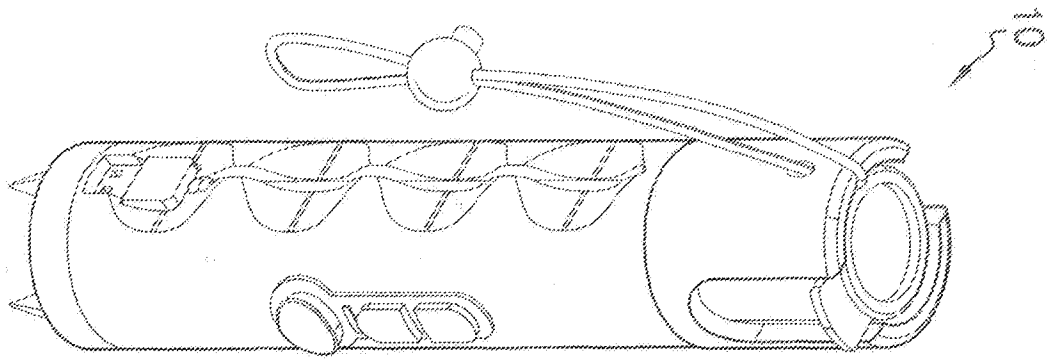
FIG. 6 is an isometric view of a 3-in-1 self-defense apparatus.

With reference now to the drawings, and in particular FIGS. 1 through 6 thereof, an example of the instant 3-in-1 self-defense apparatus employing the principles and concepts of the present 3-in-1 self-defense apparatus and generally designated by the reference number 10 will be described.

Referring to FIGS. 1 through 6 the present 3-in-1 self-defense apparatus 10 is illustrated. The 3-in-1 self-defense apparatus 10 includes a tubular handle 12 having an inside 14, a front side 16, a back side 18, a top side 20, a bottom side 22, and a plurality of concave indentations 24. Each of the plurality of indentations is configured to receive a user's finger for grip. There is a pepper spray canister 30 disposed within the top side 20 of the tubular handle 12, the pepper spray canister having an activation lever 32 and a nozzle 34. The activation lever 32 is aligned with the back side 18 of the tubular handle and the nozzle 34 is aligned with the front side 16 of the tubular handle. The activation lever 32 has a depressed position, and the depressed position of the activation lever selectively releases a pepper spray from the nozzle 34 of the pepper spray canister 30.

A rechargeable battery 35 is disposed within the inside 14 of the tubular handle 12. A plurality of indicator lights 36 is disposed within the front side 16 of the tubular handle 12 proximal the bottom side 22 thereof. The plurality of indicator lights 36 is in operational communication with the rechargeable battery 35 and is configured to indicate a charge level of said rechargeable battery. An LED light panel 40 is disposed within the front side 16 of the tubular handle 12. The LED light panel 40 is in operational communication with the rechargeable battery 35 and is configured to blind an attacker.

A stun gun 44 is disposed within the tubular handle 12 proximal the bottom 22 thereof. The stun gun 44 has a plurality of metal contacts 46 disposed such that said plurality of metal contacts protrudes from the bottom 22 of the tubular handle 12. The stun gun 44 is in operational communication with the rechargeable battery 35 and is configured to deliver an electric shock to the attacker via the plurality of metal contacts 46.

A USB connector 50 is disposed within the back side 18 of the tubular handle 12. The USB connector 50 is in operational communication with the rechargeable battery 35 and is configured to charge said rechargeable battery. A plurality of controls 55 is disposed within the back side 18 of the tubular handle 12, with one of the plurality of controls in operational communication with the LED light panel 40 and configured to activate and deactivate said LED light panel. One of the plurality of controls is in operational communication with the stun gun 44 and is configured to activate and deactivate said stun gun. Lastly, an adjustable strap 60 is disposed to the top 20 of the tubular handle 12.

What is claimed is:

1. A 3-in-1 self-defense apparatus comprising:

a tubular handle having an inside, a front side, a back side, a top side, a bottom side, and a plurality of concave indentations, wherein each of the plurality of indentations is configured to receive a user's finger for grip;

a pepper spray canister disposed within the top side of the tubular handle, the pepper spray canister having an activation lever and a nozzle, wherein the activation lever is aligned with the back side of the tubular handle and the nozzle is aligned with the front side of the tubular handle;

wherein the activation lever has a depressed position, and the depressed position of the activation lever selectively releases a pepper spray from the nozzle of the pepper spray canister;

a rechargeable battery disposed within the inside of the tubular handle;

a plurality of indicator lights disposed within the front side of the tubular handle proximal the bottom side thereof, wherein the plurality of indicator lights is in operational communication with the rechargeable battery and is configured to indicate a charge level of said rechargeable battery;

an LED light panel disposed within the front side of the tubular handle, wherein the LED light panel is in operational communication with the rechargeable battery and is configured to blind an attacker;

a stun gun disposed within the tubular handle proximal the bottom thereof, wherein the stun gun has a plurality of metal contacts disposed such that said plurality of metal contacts protrudes from the bottom of the tubular handle;

wherein the stun gun is in operational communication with the rechargeable battery and is configured to deliver an electric shock to the attacker via the plurality of metal contacts;

a USB connector disposed within the back side of the tubular handle, wherein the USB connector is in operational communication with the rechargeable battery and is configured to charge said rechargeable battery;

a plurality of controls disposed within the back side of the tubular handle, wherein one of the plurality of controls is in operational communication with the LED light panel and is configured to activate and deactivate said LED light panel, wherein one of the plurality of controls is in operational communication with the stun gun and is configured to activate and deactivate said stun gun; and an adjustable strap disposed to the top of the tubular handle.

* * * * *